US008708766B2

(12) United States Patent
Pedersen et al.

(10) Patent No.: US 8,708,766 B2
(45) Date of Patent: Apr. 29, 2014

(54) CHILD'S ACTIVITY TOY

(75) Inventors: Bradley D. Pedersen, Mississauga (CA); Kyle Jeffs, Mississauga (CA)

(73) Assignee: Tech 4 Kids, Inc., Ontario (CA)

( * ) Notice: Subject to any disclaimer, the term of this patent is extended or adjusted under 35 U.S.C. 154(b) by 366 days.

(21) Appl. No.: 13/253,020

(22) Filed: Oct. 4, 2011

(65) Prior Publication Data

US 2012/0088431 A1 Apr. 12, 2012

Related U.S. Application Data

(60) Provisional application No. 61/389,680, filed on Oct. 4, 2010.

(51) Int. Cl.
*A63H 33/26* (2006.01)

(52) U.S. Cl.
USPC ..... 446/129; 446/146; 446/475; 434/409

(58) Field of Classification Search
USPC ..... 446/129, 135, 137, 146; 434/409
See application file for complete search history.

(56) References Cited

U.S. PATENT DOCUMENTS 2,722,754 A * 11/1955 Slote ..... 434/190
2,883,765 A * 4/1959 Blaine ..... 434/238
3,093,919 A * 6/1963 Holtz ..... 40/621
3,224,126 A * 12/1965 Bogusz ..... 40/621
3,425,694 A * 2/1969 Norris ..... 273/399
3,433,478 A * 3/1969 Span et al. ..... 273/443
3,685,170 A * 8/1972 Fairleigh ..... 434/248
4,192,084 A * 3/1980 O'Riordan ..... 434/278
4,396,029 A * 8/1983 Anderson ..... 453/15
4,511,341 A * 4/1985 Spirk et al. ..... 446/9
4,557,282 A * 12/1985 Childers et al. ..... 453/6
4,564,037 A * 1/1986 Childers et al. ..... 453/6
4,570,655 A * 2/1986 Raterman ..... 453/10
4,586,522 A * 5/1986 Taipale et al. ..... 453/10
4,593,709 A * 6/1986 Duplessy ..... 453/9
4,606,361 A * 8/1986 Nottingham et al. ..... 453/3
4,902,011 A * 2/1990 Seaton ..... 273/449
5,009,627 A * 4/1991 Rasmussen ..... 453/10
5,039,603 A * 8/1991 Pocius ..... 434/188
5,106,338 A * 4/1992 Rasmussen et al. ..... 453/10
5,131,849 A * 7/1992 Perrero ..... 434/281
5,209,486 A * 5/1993 Brotz ..... 273/239
5,209,696 A * 5/1993 Rasmussen et al. ..... 453/10
5,263,866 A * 11/1993 Campbell ..... 434/416
5,425,669 A * 6/1995 Geib et al. ..... 453/10
5,514,034 A * 5/1996 Jones et al. ..... 453/10
5,564,978 A * 10/1996 Jones et al. ..... 453/17
5,573,405 A * 11/1996 Evans ..... 434/238
5,577,915 A * 11/1996 Feldman ..... 434/238
5,664,780 A * 9/1997 Bricker ..... 273/239
5,666,712 A * 9/1997 Cvetkov ..... 29/458
5,902,178 A * 5/1999 Perkitny ..... 453/9

(Continued)

*Primary Examiner* — Gene Kim
*Assistant Examiner* — Joseph B Baldori
(74) *Attorney, Agent, or Firm* — Adam K. Sacharoff; Much Shelist

(57) ABSTRACT

A child's activity toy having a support board to which a variety of differently colored discs can be magnetically attached. The colored discs are dispensed with disc dispenser pens adapted to house and dispense the discs, and thus create a colored image. The image created can be viewed using 3D imaging technology, and an enhanced visual effect can be observed when the images are observed under Ultraviolet light. A disc collection and sorting system is also included in the activity toy of the present invention.

9 Claims, 4 Drawing Sheets

(56) References Cited

U.S. PATENT DOCUMENTS

| | | | | |
|---|---|---|---|---|
| 6,030,284 | A * | 2/2000 | Frank | 453/3 |
| 6,165,063 | A * | 12/2000 | Perkitny | 453/9 |
| 6,464,507 | B1 * | 10/2002 | Bailey | 434/247 |
| 6,585,554 | B1 * | 7/2003 | Hewitt et al. | 446/146 |
| 6,837,714 | B2 * | 1/2005 | Womack | 434/238 |
| 7,144,317 | B1 * | 12/2006 | Marcuso | 453/3 |
| 8,540,548 | B2 * | 9/2013 | Pedersen et al. | 446/475 |
| 2010/0230233 | A1 * | 9/2010 | De Raedt et al. | 194/302 |
| 2011/0009028 | A1 * | 1/2011 | Gurdin et al. | 446/132 |
| 2012/0088431 | A1 * | 4/2012 | Pedersen et al. | 446/129 |
| 2012/0171921 | A1 * | 7/2012 | Pedersen et al. | 446/146 |
| 2013/0052907 | A1 * | 2/2013 | Pedersen et al. | 446/146 |
| 2013/0171304 | A1 * | 7/2013 | Huntley | 426/231 |

* cited by examiner

CHILD'S ACTIVITY TOY

FIELD OF THE INVENTION

This invention relates generally to a child's activity toy, and in particular, an activity toy that allows the child to draw pictures using specifically designed pieces, holders for the pieces, and a system for sorting and reloading the pieces into the holders.

BACKGROUND OF THE INVENTION

Children enjoy drawing, painting, and playing with bright and multiple colored toys and other pieces. Numerous designs are known for providing simple activity centres or drawing tools comprising a flat board onto which paper, or the like can be attached and onto which, a child can attached letters, shaped designs, or the like, or draw free-hand to produce an image.

While these types of devices are generally well received by most children, it would still be advantageous to provide an activity toy that would allow the child to "paint" a picture using brightly colored pieces, and then be able to collect, sort and re-use those pieces to produce additional images.

SUMMARY OF THE INVENTION

An exemplary implementation of the child's activity toy of the present invention provides a "drawing" or support board which is used in combination with a series of drawing pieces. The pieces are preferably circular discs, and are preferably held to the drawing board using magnetism. Either the discs or the board, can be magnetic, but preferably, the board comprises at least one area which acts as a magnetic, and the discs are made of steel or some other magnetic material, or the like, so as to adhere to the magnetic board.

Both the board and the discs are preferably coated, and in respect of the discs, a variety of different coloured discs are provided to the child.

In use, the child places the discs onto the board in order to produce an image from the coloured discs. In a preferred embodiment, the child is provided with a board, or a board cover (such as a cover of paper, cloth, plastic film, or the like) on which the outline of the drawing is printed. The child fills in the open areas outlined on the drawing using the coloured discs provided.

In a preferred embodiment, the coloured image is viewed by the child using three dimensional (3D) imaging technology. In particular, in the preferred embodiment, the child uses a type of three dimensional imaging technology known as "Chromadepth" imaging technology, which was developed by American Paper Optics. This technique produces a 3D effect based upon differences in the diffraction of color through a special prism-like holographic film which is typically fitted into glasses worn by the viewer. Chromadepth glasses purposely exacerbate chromatic aberration and give the illusion of colors taking up different positions in space, with red being in front, and blue being in back. In more detail, the lenses of the Chromadepth glasses, are oriented sideways, so that the overall bending effect creates an image wherein it appears that parts of the scene have been shifted horizontally inwards (ie, towards the center of the user's face). In its typically configuration, the red hues are shifted more than the greens and the greens are shifted more than the blues. Thus, red elements in the 3D scene appear to converge closest to the viewer and the blue elements appear to converge the farthest away. This technique works particularly well with the sky, sea or grass as a background, and redder objects in the foreground.

Any suitably coloured material can be given a 3D effect as long as the color spectrum is put into use with the foreground being in red, and the background in blue. From front to back the scheme therefore follows the visible light spectrum, from red to orange, yellow, green and blue. As a result, ChromaDepth works best with artificially produced or enhanced pictures, since the color of the object indicates and controls the "depth" of the image.

However, unlike other 3D imaging techniques, such as anaglyph images or polarization, creating real-life ChromaDepth pictures without manual enhancement is practically impossible, since the colour of an actual picture may not correspond with the Chromadepth colour scheme.

However, the Chromadepth technique does provide some distinct advantages over other 3D imaging techniques, since the Chromadepth image contains its apparent depth information all in one image. This eliminates the ghosting effect seen in other 3D imaging technique when the user view the objects or images without the appropriate 3D glasses. Thus, ChromaDepth images can be viewed comfortably and clearly without using the 3D glasses, even though the 3D effect will not be perceivable without them.

In the present invention, the discs are preferably coloured using different colours so that the result image has a 3D effect when viewed through Chromadepth glasses.

More preferably, the inventors have discovered that the Chromadepth technology is enhanced if the colours selected use fluorescent pigments. As such, in a preferred embodiment, the image is viewed with Chromadepth glasses wherein at least some of the coloured discs are coloured using fluorescent pigments.

Still more preferably, the inventors have also discovered that the Chromadepth technology is further enhanced if the image is viewed under Ultraviolet (UV) light. The UV light can be provided by overhead lighting, but more preferably, is provided by the UV light built into the activity toy, or, is provided by UV lamps built into the Chromadepth glasses. In this option, UV lamps are included in the glasses, and light from the glasses is projected onto the drawing board.

As such, in a further aspect, the present invention also provides Chromadepth 3D imaging glass comprising at least one UV lamp, for projection of UV light on to the image observed, with the Chromadepth glasses.

In a further feature, the activity toy of the present invention includes a disc dispenser which holds the discs, with one dispenser used for each separate colour. The dispenser has a general pen shaped appearance including a hollow tube in which the coloured discs can be stacked. When held next to the magnetic drawing board, the coloured steel discs are attracted to the board, and the disc can be individually released by releasing a containment catch on the dispenser. Thus, in use, the child brings the end of the dispenser near the board, releases the containment catch, and a coloured disc exits the dispenser, and attaches itself to the board. By releasing several discs, the child can essentially cover the bulk of the area in the outline, in a manner similar to colouring or painting.

The child can use different coloured discs to colour various items, and by selecting these different colours can create a 3D image when viewed through the Chromadepth glass. This 3D image is enhanced when viewed under UV light, and is particularly enhanced when fluorescent pigments are used.

The support board can be any suitable colour, but black is preferred since it does not interfere with the Chromadepth 3D image. The support board might also simply be a support for overlays, including overlayments which are printed on paper, cardboard, cloth, plastic film, or the like. The support board might also include a clear plastic screen that can be edge-lit with UV light.

Still further, the board includes a magnetic surface that extends upwards to the top of the board, and then curls around the top of the board before preferably partially extending down the back of the support board. This assists in collection and sorting of the disks, as will be described hereinbelow.

Most, if not all of the back of the board, however, is a non-magnetic area.

When the child is finished with the activity centre, or wishes to draw another image, the discs are slid up the board (using any suitable means such as a ruler, plastic slider, or an integral plastic slider built into the device, or the like), where they proceed over the top of the curved magnetic board, down the back of the activity toy, and then are released into a preferably enclosed catchment area located on the back of the activity board.

Once the discs fall into the catchment area, the discs can be sorted using a sorting device, as herein described.

One suitable sorting device operates as follows.

The coloured discs are typically between 1 and 4 cm, and more preferably between 2 and 3 cm in diameter. They also have a thickness of between 0.1 and 2 cm, and more preferably, between 0.3 and 0.8 cm.

In an exemplary embodiment of the present device, the discs preferably have at least two different diameters, and preferably each diameter setting includes 3 differently coloured disc. Thus, the user has 6 differently coloured discs, each of which has its own unique combination of diameter and thickness.

The first component of the sorting device preferably comprises a sorting wheel being a generally circular wheel, with a crank that can be used for spinning the wheel, in one direction. The sorting wheel has a equally spaced collection of regularly shaped openings on its perimeter, which are adapted to receive any one of the coloured discs.

The openings are sized and shaped so as to collect any of the discs. For example, circular discs would be caught in a wheel having semi-circular openings on its outer diameter. While circular shapes are most convenient, other shapes, such as square discs, or the like, might also be used.

Additionally, the catchment area is enclosed, preferably by a clear plastic, so that the only mechanism for the discs to exit the catchment area, is through the sorting wheel.

In one embodiment, the discs collected in the wheel pass by at least one exit point which has an exit opening size which is related to the disc size. When passing the first exit point, only discs below a selected diameter are able to exit the sorting wheel, while any larger discs must proceed to a second exit point, where any remaining discs are removed from the sorting wheel. As such, the six discs (of this example) are first sorted into two different groups.

To exit the sorting wheel, additional exit openings, each having (in order) a slightly larger exit opening size, might also be used to further sort the discs of the invention using the sorting wheel. In this case, an increased number of different disc diameters can be used to provide additional sorting capability. As such, the number of different disc diameters is preferably between two and 10, and more preferably between 2 and 6. Most preferably, however, there are only two different disc diameters.

The discs are also preferably provided with different thicknesses. Once the discs have left the sorting wheel, they roll (on end) down a "ramp" section located at each exit opening, which ramp features slots of different widths. Once a disc reaches a slot (or opening) with a width greater than its thickness, the disc falls into the slot. If the disc is thicker than the slot, it will continue over the slot, and eventually fall through the slot with a larger opening.

The number of disc thickness and/or disc diameters used, is preferably between 2 and 10, and more preferably, between 2 and 5. Most preferably, there are 2 different disc diameters so that there are two different sized openings, and preferably, there are three different disc thicknesses, and thereby, three different sized slots.

For example, for a two disc diameter, with three disc thicknesses, a total of 6 different sized discs can be sorted. In the present invention, the child therefore has a total of 6 different coloured discs that can be used on the magnetic board, and then moved to the sorting system, once the drawing is completed.

Other approaches might be taken. For example, six different disc diameters might be used, with three of the discs having a diameter so as to pass through the first exit from the sorting wheel, and three will pass through to the second exit. On each ramp, an opening can be provided that is matched to the disc size, with the smallest diameter opening closest to the sorting wheel exit. Larger discs will pass over the smaller opening and continue down the ramp until they reach the correct sized opening. At this point, they drop into the opening.

It will be noted that other combinations of these sorting techniques can be envisioned by the skilled artisan.

At the bottom of each slot or opening, is a recess provided to collect the sorted discs. Further, the recess is preferably adapted to receive a disc dispenser. The end of the disc dispenser is aligned within the slot recess, and discs falling through the slot or opening, fall into the disc dispenser.

The end of the disc dispenser is held open when connected to the recess, so as to allow the discs to fall into the dispenser.

In this manner, the child is able to quickly and easily return the discs to its correct dispenser, and each of the dispensers is now ready for the next drawing. This disc collection operation provides entertainment to the child, and reduces the number of discs which will be lost during use since the discs preferably remain either in the disc dispenser, or are magnetically attached to the board.

When not in use, the disc dispensers themselves can also be stored in their respective recesses in the activity toy, so as to also minimize the potential loss of the disc dispensers.

BRIEF DESCRIPTION OF THE DRAWINGS

Embodiments of this invention will now be described by way of example only in association with the accompanying drawings in which.

DETAILED DESCRIPTION OF THE PREFERRED EMBODIMENTS

Figure 1:
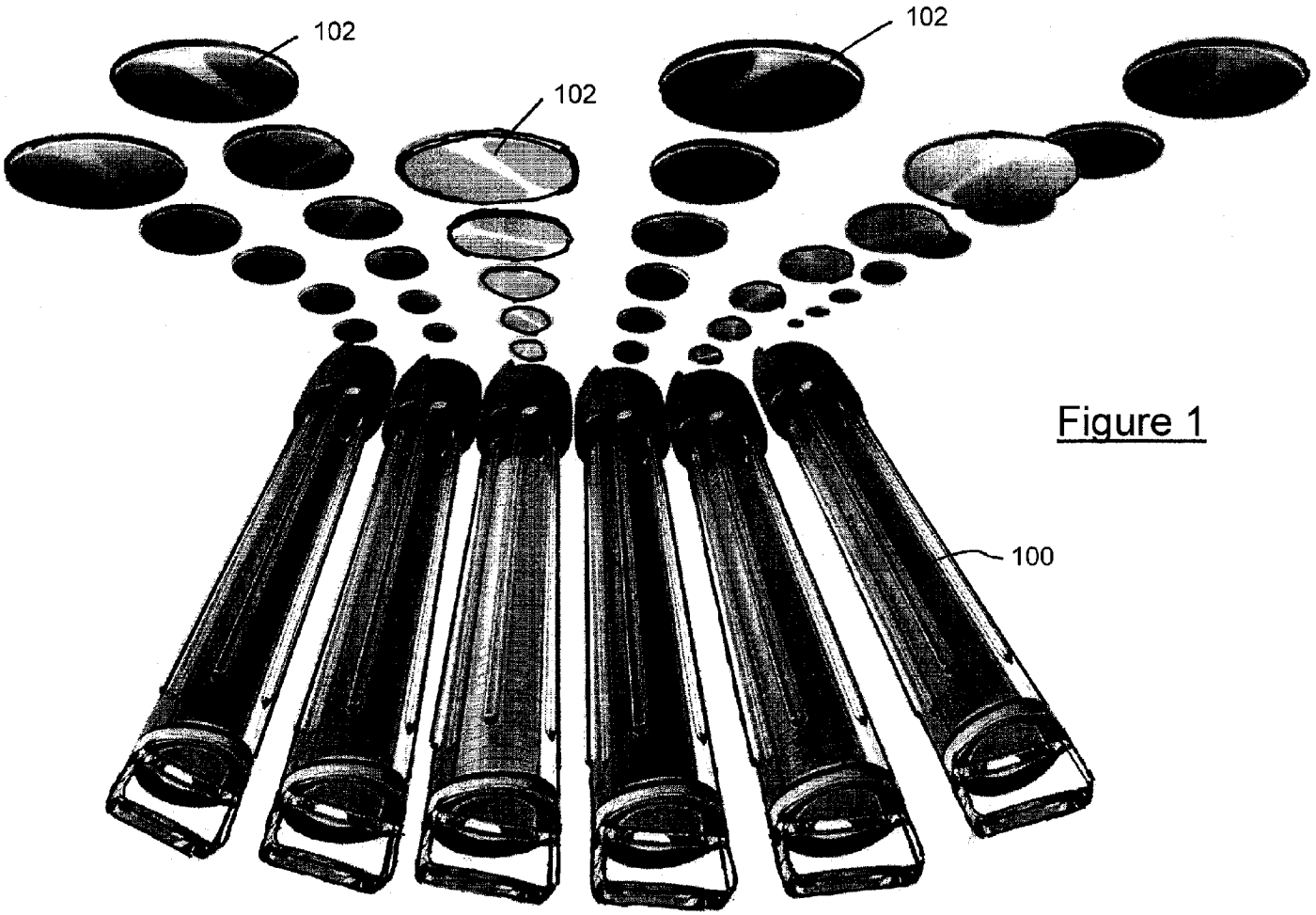
FIG. 1 is a image of six disc dispensers, and related discs.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, six disc dispensers 100, are shown having each having a plurality of coloured discs 102. Discs 102 are made of coated steel, and are different colours, so that each dispenser 100 dispenses differently coloured discs. Discs 102 are preferably coated with colours containing fluorescent pigments.

In FIG. 2, an activity toy 10 is shown in FIGS. 2A, 2B, 2C and 2D, having a configuration similar to a computer monitor. Toy 10 includes a stand 12, and a display screen 14. Display screen 14 acts as a support board, and is coated with a thin magnetic pad, and is black in colour.

Screen 14 can be illuminated using an overhead UV light, a UV light built into the activity toy, but in a preferred embodiment, UV lights are included in the Chromadepth 3D imaging glasses, and light from the glasses is projected onto the drawing board.

Figure 2D:
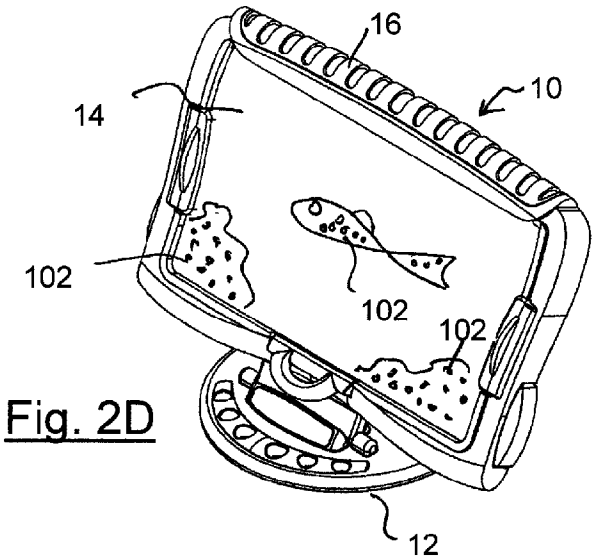
FIG. 2 is a collection of images showing the front surface of the activity toy support board.
Figure 2C:
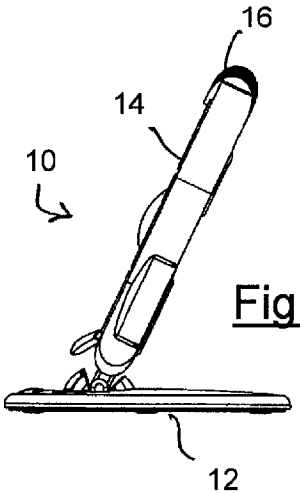
Figure 2B:
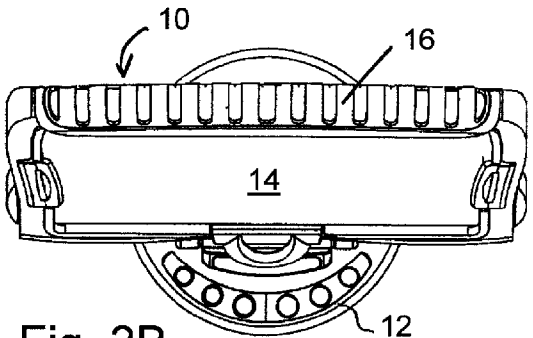
Figure 2A:
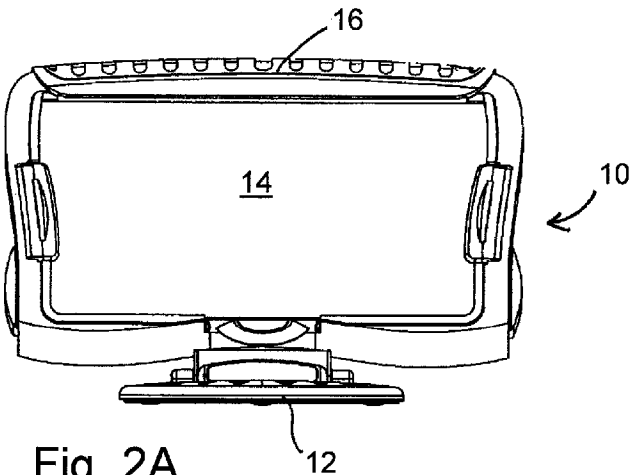

In FIG. 2D, a pre-printed image of a fish is shown, which is partially covered in discs 102. The rocks, also shown in FIG. 2D are "coloured" with discs 102 of a different colour. When viewed under UV light, using Chromadepth glasses, and using the fluorescent pigmented coloured discs, the fish will appear to be at a different image "depth" than the rocks or the background, and thereby, an enhanced 3D image will be viewed.

At the top of screen 14 is a cover section 16 which is open to the screen 14. After the drawing is completed, the child pushes the discs 102 under cover 16, using a plastic ruler, or the like, so that the discs pass over the top of screen 14, and fall into an enclosed catchment area 20, best seen in FIG. 3.

Figure 3B:
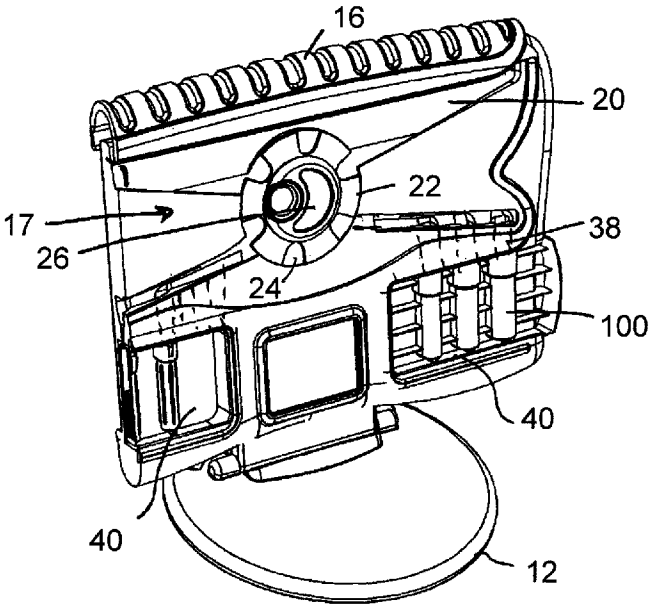
FIG. 3 is a collection of images showing the back surface of the activity toy, having a disc sorting system included therein.
Figure 3A:
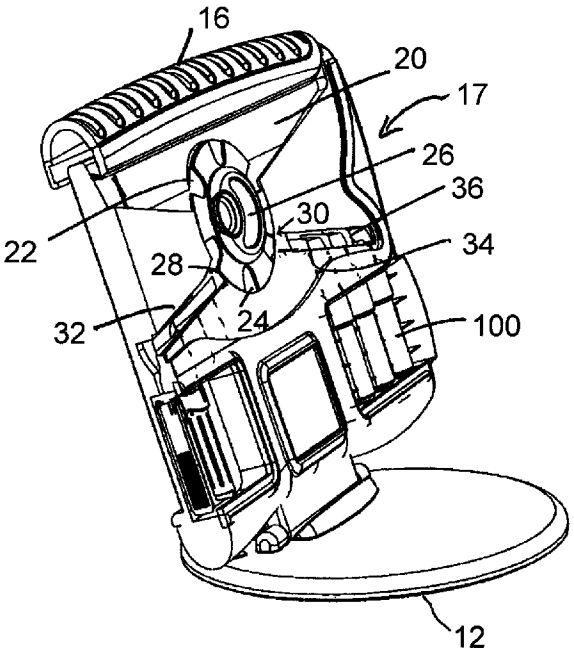

In FIG. 3, the rear view of activity toy 10 is shown, including sorting system 17. In FIG. 3A, the opening under cover 16 from screen 14 can be seen. It will be noted that screen 14 can be tilted forward on base 12, for this operation.

The discs fall towards sorting wheel 22, which contains 6 semi-circular openings 24 adapted to receive discs 102. Sorting wheel 22 is turned using a handle 26, and the discs are moved towards the discs exits 28 and 30. Three different sizes of discs fall through exit 28, and the other three different sizes of discs 102 fall through exit 30. Once the discs exit the sorting wheel, they roll down ramps 32 and 34, and fall into opening 36 which are the same size as the appropriate discs 102. The discs fall through tubes 38, shown in outline, and fall into dispensers 100.

Only four of the six dispensers 100 are shown in recesses 40, in the back of activity toy 10.

Figure 4:
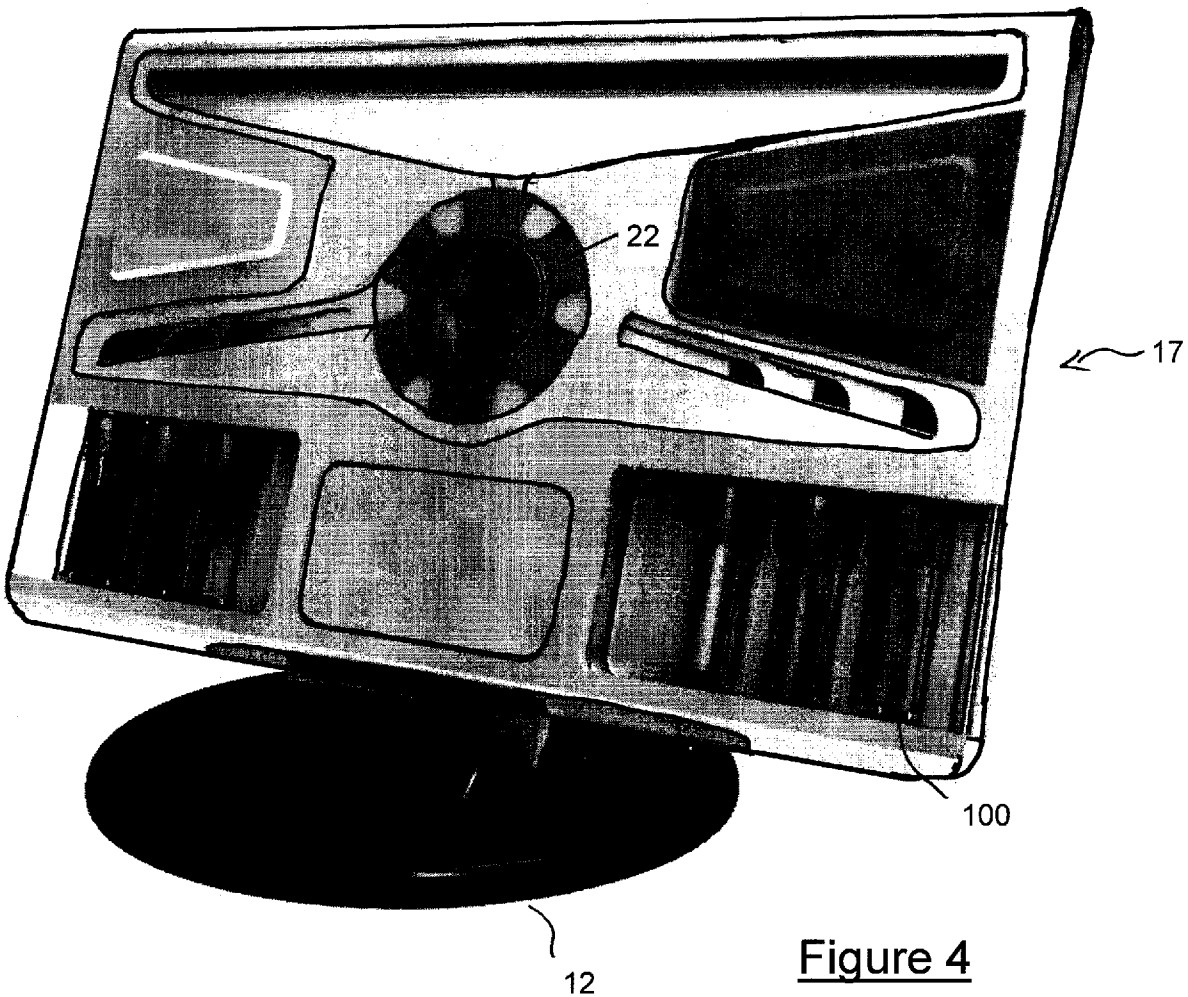
FIG. 4 is a further image of the back surface of the activity toy with included sorting system.

A further image of the back side of toy 10, showing the sorting system and 6 dispensers, is also shown in FIG. 4. Use of the sorting system is as previously described herein.

Finally, it should be noted that even in situations where use of the UV lamp and Chromadepth glasses is not desired, the child still has a multiple activity toy 10 that can be used in a manner similar to prior art multiple activity toys. The child merely uses discs 102 to create a normally appearing image, and then collects the discs 102 using the sorting system 17.

In use, therefore, the child has the option of simply using the discs and board alone as a simple multiple activity toy. However, the child also has the option of using the Chromadepth glasses to provide an enhanced 3D effect when viewing the fluorescent coloured discs, and in its most preferred option, the child can use a combination of fluorescent coloured discs, with Chromadepth glasses, when viewed under UV light, to achieve the optimal visual effect Thus, it is apparent that there has been provided, in accordance with the present invention, a child's activity toy, which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Also, unless otherwise specifically noted, all of the features described herein may be combined with any of the above aspects, in any combination.

Further, use of the terms "he", "him", or "his", is not intended to be specifically directed to persons of the masculine gender, and could easily be read as "she", "her", or "hers", respectively.

Finally, while this discussion has addressed prior art known to the inventor, it is not an admission that all art discussed is citable against the present application.

What is claimed is:

1. A child's activity toy set comprising:

a support stand having a display with a front magnetic display portion, the support stand further having a non-magnetic catchment area positioned behind the front magnetic display portion and further having a top cover section open to the front magnetic display portion and connected to the non-magnetic catchment area, and wherein the front magnetic display portion extends upwardly and curls around a top portion of the front magnetic display portion and leading to the non-magnetic catchment area;

a series of drawing pieces, wherein said drawing pieces are magnetically attracted to said front magnetic display portion, wherein said drawing pieces include at least two different sizes and/or thicknesses of circular discs;

a disc collection system secured to the support stand under the non-magnetic catchment area, the disc collection system having:

a sorting wheel, with a handle for manually spinning the sorting wheel, the sorting wheel having openings sized to correspond to the different sizes and/or thicknesses of the circular discs, and at least one ramp section under the sorting wheel, the at least one ramp section having an entrance to receive a circular disc from the sorting wheel and having multiple slots, each slot being sized to correspond to a specific size and/or thickness of the circular disc, such that one particular circular disc from the different sized and/or thickness of the circular disc is only able to exit the at least one ramp section through one slot; and a plurality of disc dispensers, each disc dispenser being sized to fit within one of the slots of the multiple slots, and each disc dispenser having a dispenser top end sized to receive a similar sized circular disc fed from the sorting wheel and down the at least one ramp section and each disc dispenser having a dispenser bottom end sized to permit at least one circular disc, held in said disc dispenser, to be pulled from the dispenser when said bottom end is positioned against the front magnetic display portion, wherein one or more circular discs positioned on the front magnetic display portion are able to be moved around the top portion of the front magnetic display portion and fall into said non-magnetic catchment area, into the disc collection system and then sorted into a properly sized slot for receipt into its corresponding disc dispenser.

2. The child's activity toy as claimed in claim 1, wherein said front magnetic display portion is covered with a board cover on which an outline of a drawing is printed.

3. The child's activity toy set as claimed in claim 1, wherein a plurality of said disc dispensers are provided, and each disc dispenser contains discs of a different color.

4. The child's activity toy set as claimed in claim 1, wherein said disc dispenser has a pen shaped appearance and comprises a hollow tube in which the discs can be stacked.

5. The child's activity toy set as claimed in claim 4, wherein said discs are magnetically attracted to said front magnetic display portion, and are individually released by releasing a containment catch on said disc dispenser so that a disc can be withdrawn from said disc dispenser by magnetic attraction.

6. The child's activity toy set as claimed in claim 1, wherein the number of disc thickness or disc diameters used, is between 2 and 10.

7. The child's activity toy set as claimed in claim 1, wherein said catchment area is enclosed so that the only mechanism for said discs to exit the catchment area, is through said sorting wheel.

8. The child's activity toy as claimed in claim 1, wherein said disc dispenser top end is held open while connected to said slot, so as to allow the discs to fall into the dispenser.

9. The child's activity toy as claimed in claim 1, wherein said disc dispensers can be stored in their respective slots in said child's activity toy.

* * * * *